United States Patent [19]

Bennardo

[11] Patent Number: 4,577,750

[45] Date of Patent: Mar. 25, 1986

[54] IMPREGNABLE LOCKING SYSTEM

[75] Inventor: Gilbert Bennardo, Nice, France

[73] Assignee: S.A.M. Microtechnic, Monaco

[21] Appl. No.: 755,149

[22] Filed: Jul. 15, 1985

[30] Foreign Application Priority Data

Dec. 11, 1984 [FR] France ..... 84 19035

[51] Int. Cl.[4] ..... A45C 13/10

[52] U.S. Cl. ..... 206/1.5; 206/461; 220/230; 220/315

[58] Field of Search ..... 206/461, 470, 1.5, 444; 220/230, 315, 327

[56] References Cited

U.S. PATENT DOCUMENTS

| | | | |
|---|---|---|---|
| 2,591,271 | 4/1952 | Levereth | 206/1.5 |
| 4,120,400 | 10/1978 | Kotyuk | 206/1.5 |
| 4,300,674 | 11/1981 | Davet | 206/1.5 |
| 4,319,684 | 3/1982 | Backman et al. | 206/470 |
| 4,367,822 | 1/1983 | Pasternack et al. | 206/1.5 |
| 4,437,566 | 3/1984 | Szahler | 206/1.5 |

*Primary Examiner*—Joseph Man-Fu Moy
*Attorney, Agent, or Firm*—Erwin S. Teltscher

[57] ABSTRACT

Impregnable locking system of the fastening of display-boxes called "blisters", consisting in a box in two articulated halves having on the side opposite their hinge fastening flaps destined to be held one against the other by this system, characterized in that it consists in a clip destined to cover these two flaps, and between which is attached a transversal shaft, a vertical notch made in the flaps allowing this shaft to go through when the clip is put into place, two gears being slid onto this shaft, between the outer side of each flap and the corresponding side of the clip, the means being provided so that these gears are constantly pushed towards each other, and once this clip placed on the flaps, the gears come to rest in the lodgings made in the outer sides of the flaps, therefore immobilizing the clip onto the flaps, external means being provided to push the gears in the opposite direction to take them out of the lodgings to allow the extraction of the clip and to free the flaps of the blister to allow its opening.

7 Claims, 13 Drawing Figures

IMPREGNABLE LOCKING SYSTEM

THE SUMMARY OF THE INVENTION

The present invention concerns a system for the impregnable locking of the fastening of display boxes commonly known as "blisters"; they consist in first a box with two articulated halves destined to receive the product to be sold, and second fastening parts, respectively interdependent on the halves, that are to be held one against the other by a fastening system, supposedly impregnable.

To avoid shop-lifting, these blisters are of large sizes, therefore cannot be hidden, and only the personnel at the store's cash register have the device that allows to open the fastening system and to give the product to the buyer.

However, the risks of theft remain high, since the blisters themselves or their fastening system can still be broken open, their impregnability being illusory.

The invention brings a satisfactory solution to this problem, thanks to a new conception of these fastening parts and their immobilization system.

In its principle, the invention consists in the fastening parts of the box being external flaps destined to be held one against the other by the fastening system; this system consists of clips destined to cover the two flaps; between these flaps a horizontal shaft is passed, a vertical notch made in these flaps allow to put the shaft in when the clip is put into place. Two gears are slid onto the shaft between the outer side of each flap and the corresponding side of the clip; means are provided so that these gears are constantly pushed towards each other, so that once this clip put into place on these flaps, the gears come to a stop in the lodgings made in the outer sides of the flaps, therefore immobilizing the clip on the flaps. External means are provided to pull these gears in the opposite direction to take them out of the lodgings to allow the extraction of the clip and to free the flaps of the blister and to open it.

In practice, the means used for moving the gears, either into fastening position, or into opening position, can be mechanical, magnetical (permanent or electromagnets) or mixed.

Therefore, according to a first realization, the first means consists in a pair of permanent magnets and the second means consists in an electro-magnet attracting soft iron parts assembled in the gears in a stronger way than the mutual attraction of the permanent magnets.

According to a second realization, the first means consists in a pair of springs pushing the gears towards each other and the second means consists in a set of magnetic elements attracting a set of magnets assembled in the gears, preferably chosen among low density materials, such as ferrites or other agglomerated type magnets.

In the two cases, the opening means consists in a fixed tunnel in which the magnetic or electro-magnetic elements are lodged, and into which the store cashier will put the clip, in such a way that the magnetic or electromagnetic elements exert an attraction on the gears superior to the forces, magnetic or mechanical, that are holding them in the lodgings in the flaps, and this frees the latter, allowing to open the blister.

In the hypothesis that such a system could still be broken into, in particular circumstances, for example, in the case, not of shop-lifting, but of a robbery in which stronger equipment might be used, a supplementary security assures the definite impregnability of the system. To this effect, the gears are rotatingly assembled between two stops on their common shaft, and the springs that are axially pushing them, exert at the same time a circular pressure which pushes them against one of the stops; the external side of each gear and the corresponding internal side of the clip have a ridge/lodging couple which prevents the gears from moving away from each other as long as the circular movement of the springs is not compensated by the use of the external magnetic elements.

In this case, means must be provided both in the "tunnel" mentioned before and on the flaps of the blister to unlock the gears once they are translating on their shaft and rotating, when the system is placed on the blister and when it is opened by the cashier.

To this effect, so as to mechanically compensate the circular effort of the springs when the system is put into place on the blister, the top parts of the internal sides of the notches in the blister flaps have inclined gradients that cooperate with the corresponding gradients in the gears, causing their rotation while allowing enough space when the system is adapted to the blister.

As to the tunnel, according to the invention, the magnetic elments should be distributed with their poles opposite those of the corresponding gears and according to a motif slightly shifted during rotation to an angle corresponding to the rotation stroke against the stops pushed by the springs.

The invention will now be described more in detail, referring to the illustrative examples hereafter, corresponding to the annexed drawings, in which.

Figure 11:
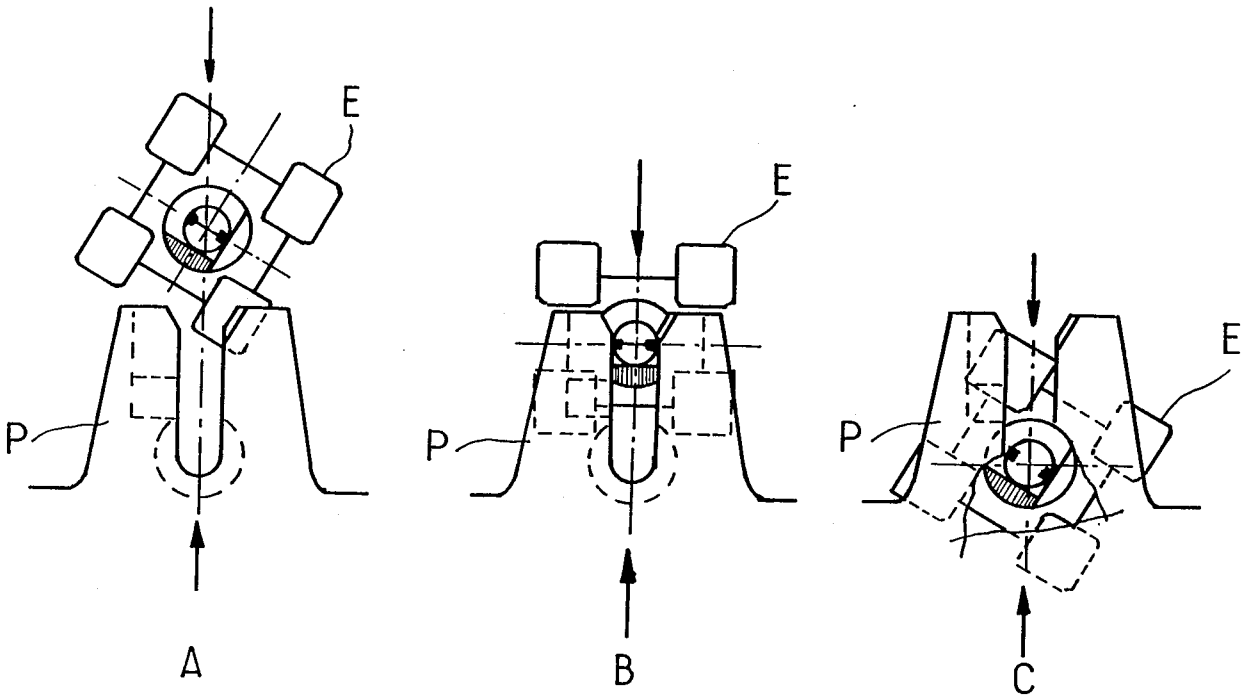

FIGS. 11*a*, 11*b* and 11*c* are three layouts showing the relative movements of the gears with respect to the flaps when the locking system is adjusted to the flaps of the blister.

Figure 1:
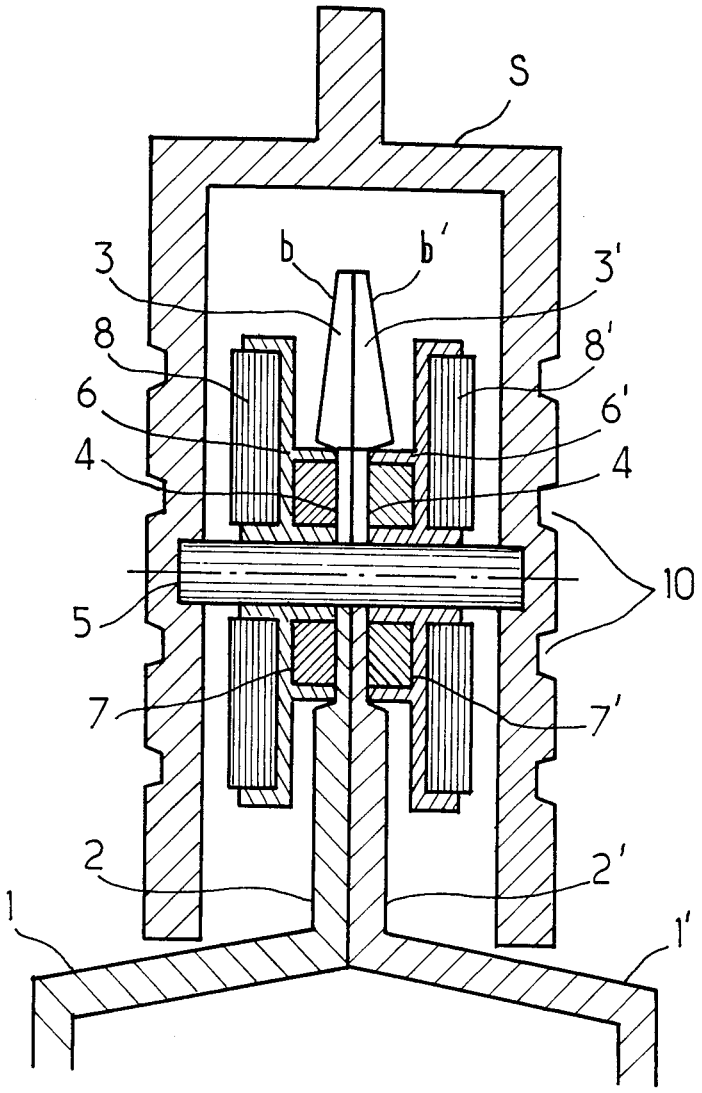
FIG. 1 is a cut-away of the top part of a blister equipped with a locking system according to the first realization of the invention.

If we first refer to FIG. 1, which schematically illustrates the principle of the invention, we see a "blister" that consists in a box in two halves 1 and 1', each interdependent on a flap 2 and 2'; these flaps are destined to be held against each other by a locking system designated by the general reference S.

This system S has the shape of stirrup covering flaps 2 and 2' thanks to a vertical notch made in the top parts of these flaps, as shown by 3 and 3', letting through a crosswise shaft 5 on which two gears 6 and 6' slide; in the shown position, these gears come to a standstill in the lodgings 4 and 4' made in the outer sides of flaps 2 and 2'.

The two gears 6 and 6' have on one hand pairs of permanent magnets 7 and 7' and on the other soft iron plates, which play the following part:

When we cover the flaps 2 and 2' with the system S, the magnets 4 and 4' pull the gears towards each other so that when the clip is not placed on the blister, they are in contact with each other; whereas when the clip is inserted above the flaps, they are separated by bevels b and b' made in the top ends of the flaps; they follow the slope of these bevels as they separate, then, arriving in front of the lodgings 4 and 4', they each return into the lodging, therefore locking the system over the flaps 2 and 2'.

It is therefore no longer possible to open the blister without an aid from the outside.

According to the invention, this aid consists in a sleeve that is the frame around an electro-magnet whose spires fit into ridges designated by 10 on FIG. 1.

This sleeve is generally attached fixedly to the store's cash register post, and the operator can send electricity to it when a blister to be opened is connected to it. When the current goes through, the magnetic field produced attracts the soft iron plates 8, in such a way that this attraction force is superior to the mutual attraction force of the magnets 7. It results in the two gears pulling apart from each other, leaving the lodgings 4 and 4', and therefore freeing the system that can be taken off of the flaps, and they in turn can be separated to open the blister.

This realization is totally satisfactory in its principle, but in certain cases, there may remain a possibility of breaking the systems, e.g. by a shock on the system or by the use of extremely popwerful magnetic materials, which would have the same effect on the two gears than the sleeve that is normally used.

This is why the variant shown in the following figures offers even more safety.

Figure 2:
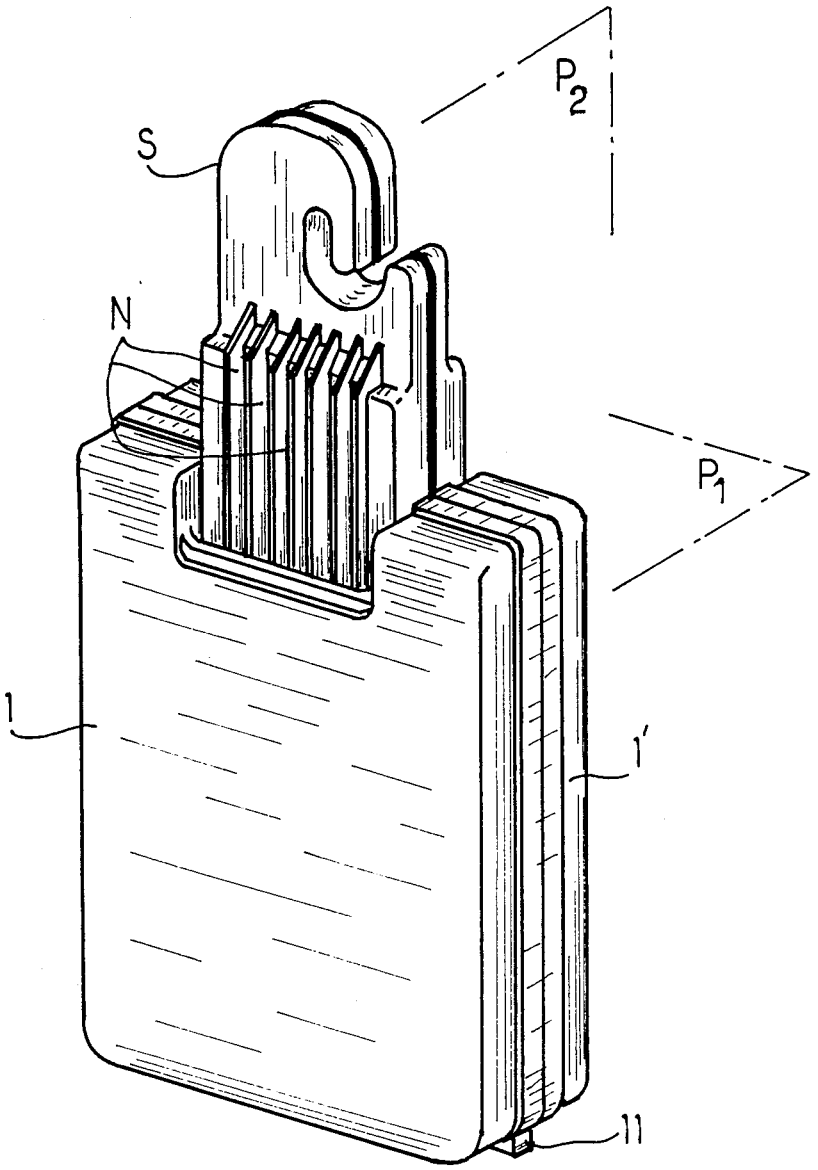
FIG. 2 is an overall view of a blister equipped with a locking system according to the second realization of the invention.
Figure 3:
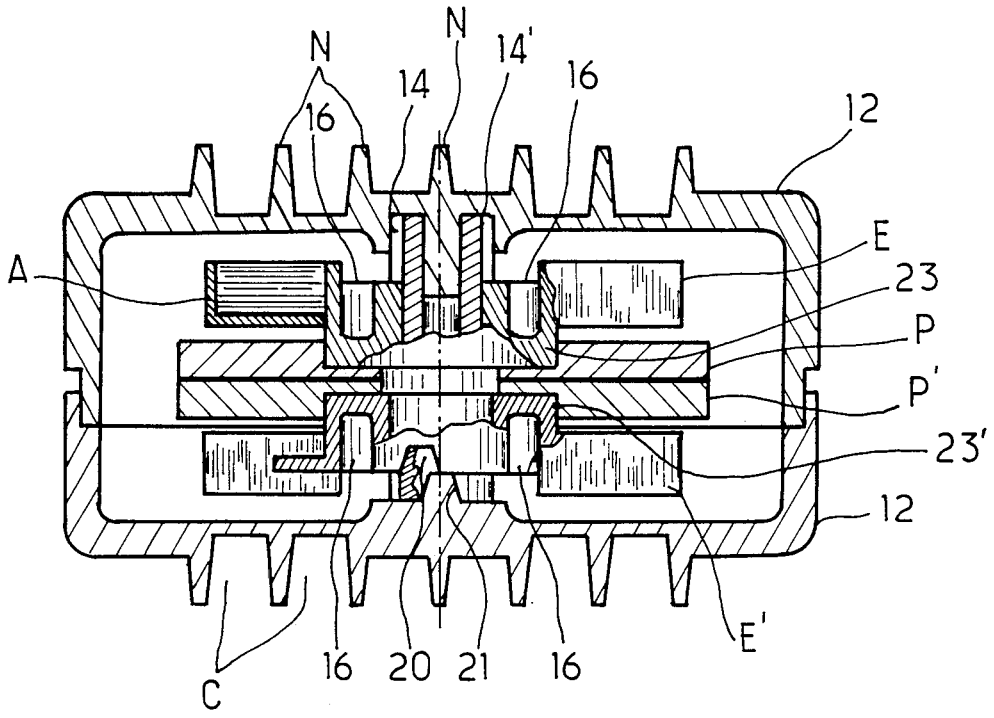
FIG. 3 is a horizontal cut-away according to layout P1 of FIG. 2 of the locking system according to the invention.
Figure 4:
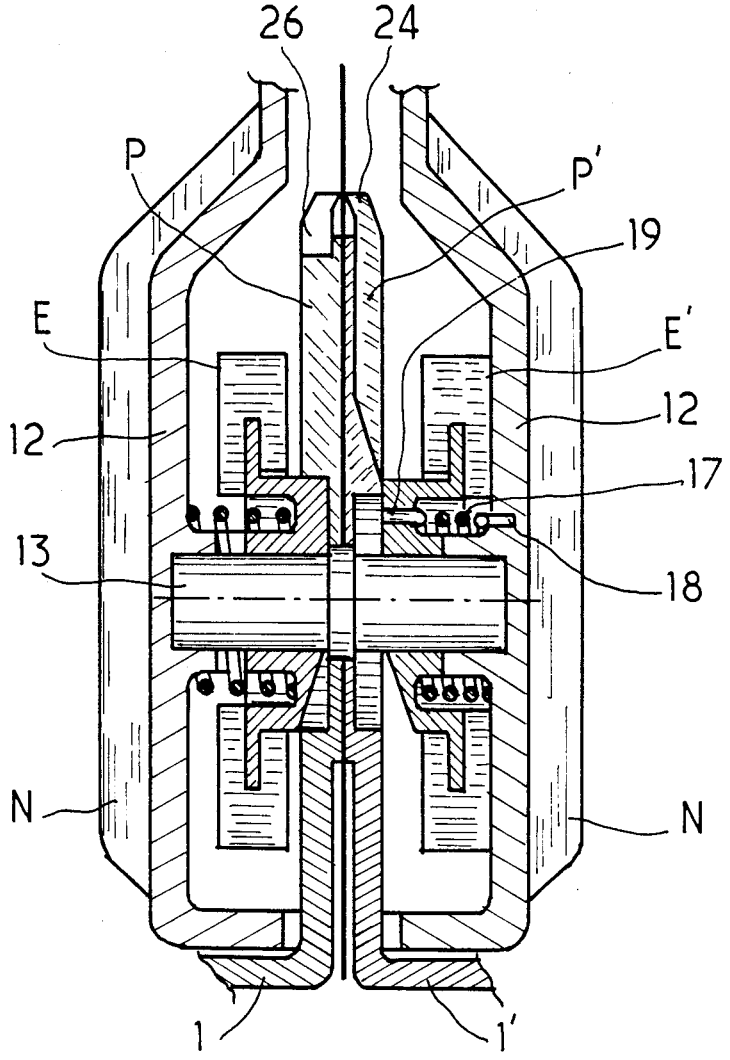
FIG. 4 is a vertical cut-away according to the layout P2 of FIG. 2 of the locking system shown in FIG. 3.
Figure 7:
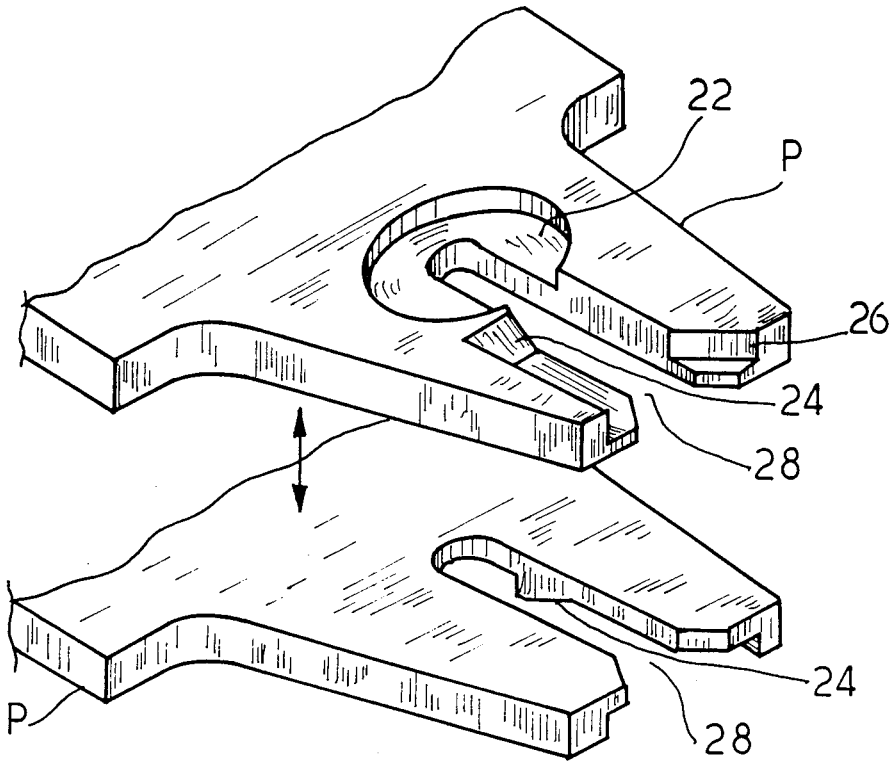
FIG. 7 is a view in perspective of both of the flaps that receive the locking system described in FIGS. 3 to 6.

If we first refer to FIG. 2, we can see, in perspective, on one hand, a blister again made of two halves 1 and 1' articulated around a shaft 11, the flaps of this blister, that appear notably in FIGS. 3 and 4, but are more specifically shown in FIG. 7, being covered by the locking system designated by the general reference S.

Figure 5:
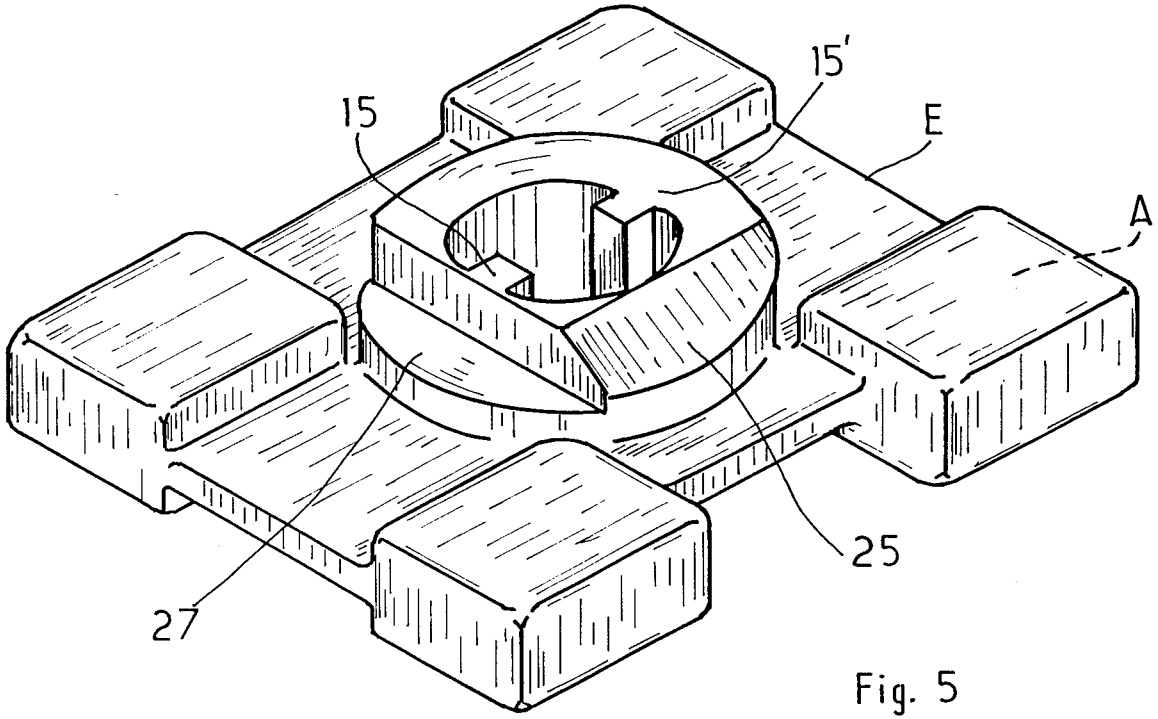
FIG. 5 is a view in perspective of one of the mobile gears that intervene in the same system.
Figure 6:
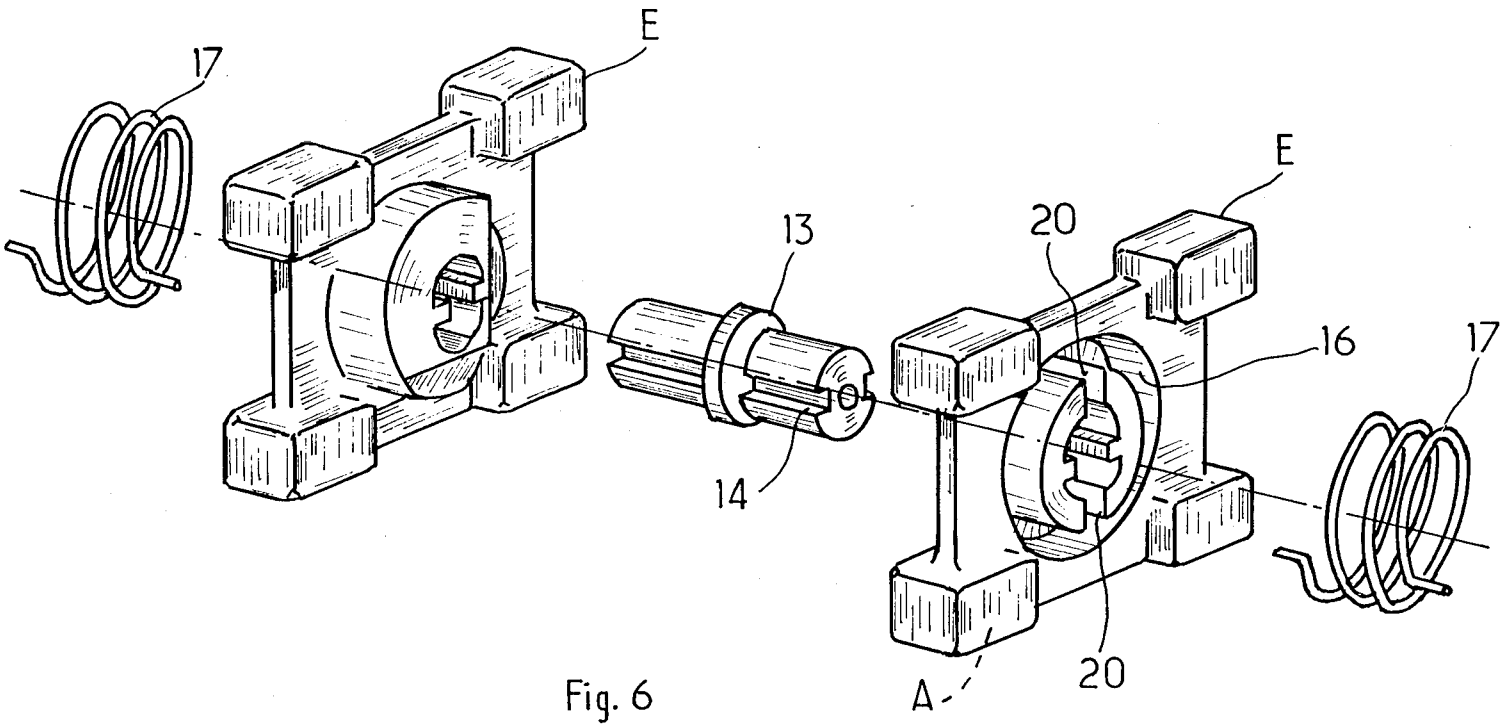
FIG. 6 is a blown-out view of all of the gears and their controls.

This system S consists in two semi-pins 12 and 12' between which is attached a shaft 13, analog to the shaft 5 of FIG. 1, i.e. two gears, like those shown in perspective in FIG. 5, and designated by the general reference E, slide on this shaft. However, this shaft has a particularity which appears more clearly in FIG. 6: along two opposite generators 14 and 14', two grooves are made to guide the two tenons 15 and 15' of each of the gears E.

Moreover, each of the gears E have a hollow sleeve 16 that is a lodging for a spring 17 which, as better seen in FIG. 4, has the particularity of acting both in compression and in torsion, these two ends 18 and 19 being immobilized on the edge of the gear E. Finally, the gear E has 4 permanent magnets A put together with the rest, and they are distributed at the four corners of a square.

The rotation effort transmitted by each of the springs 17 to the two gears E results in pushing back these gears in such a way that a notch 20 made in the body of each gear is put out of reach by a bump made on the internal side of the box 12.

Finally, in the same way as in the realization in FIG. 1, the two external sides of each of the flaps P and P' have a lodging 22, as seen notably in FIG. 7, and it is destined to receive the opposite sides 23 and 23' of the gears E as seen in FIGS. 3 and 4.

Moreover, the external sides of flaps P and P' each respectively have two cam-slopes, respectively 24 oriented in the longitudinal direction, and 25 oriented in the transversal direction, as seen clearly in FIG. 7.

These slopes are reversed in the flaps P and P' as seen in FIG. 7, so that the gears E and E' both respectively turn in the same direction, pushed by the springs 17, as will be explained on more detail in the following:

Considering only the system, i.e. before putting it on a blister, the two gears E and E' are pushed towards each other by the springs 17 and take a certain angular position also under the effect of the springs 17.

When the system is placed on the flaps of the blister, by inserting the shaft 13 into the notches 28 and 28' of the flaps P and P' cam-slopes 25 and 27 respectively of each gear E will co-operate with the cam-slopes 24 and 26 of the flaps, the first pair 26-27 making the gears turn in opposition to the spring 17 so as to bring the notch 20 in front of the bump 21 at the right time, while the cooperation between the cam-surface 24 and the cam-surface 25 results in pushing apart the gears opposed to the compression of the springs 17 and this allows to bring the gears alongside each flap, until they fall back into their lodging 22.

At this moment the gears assure a double locking: first they assure a locking by a co-operation of the gears with the flap lodgings, in the same way as in FIG. 1, but in addition, any separating of the gears, accidental or malevolently volontary, is made impossible because the gears are turned by the springs 17 in such a way that the bump 21 is no longer in front of the notch 20, therefore the gears cannot be separated, except if they are submitted to a rotation in the opposite direction by the appropriate means.

These means are shown in FIGS. 8 to 11, which show the blister opening tunnel, used at a fixed post near the store's cash registers, that frees the system from the blister and allows to give the product to the customer.

Note here that the boxes 12 of the system S have fine ribs N between which are very deep grooves designated by C, and they assure both the precise guiding of the systems into the blister opener and a deeper penetration of the blister opening element into the system.

Figure 8:
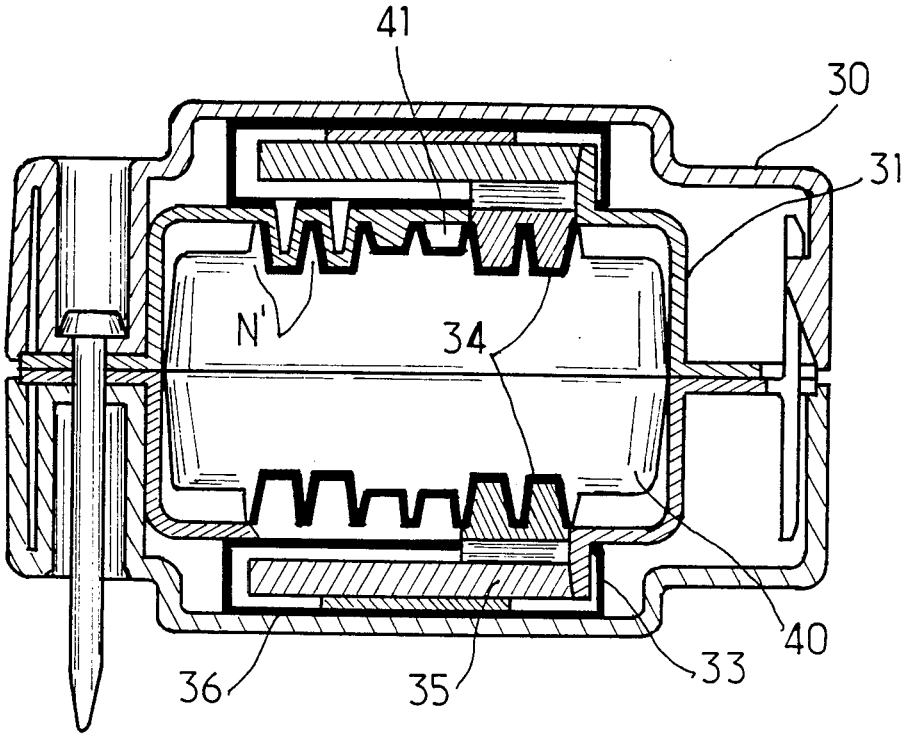
FIG. 8 is a vertical cut-away, transversal to the gliding shaft of the blister, of the blister-opening tunnel according to the invention.
Figure 9:
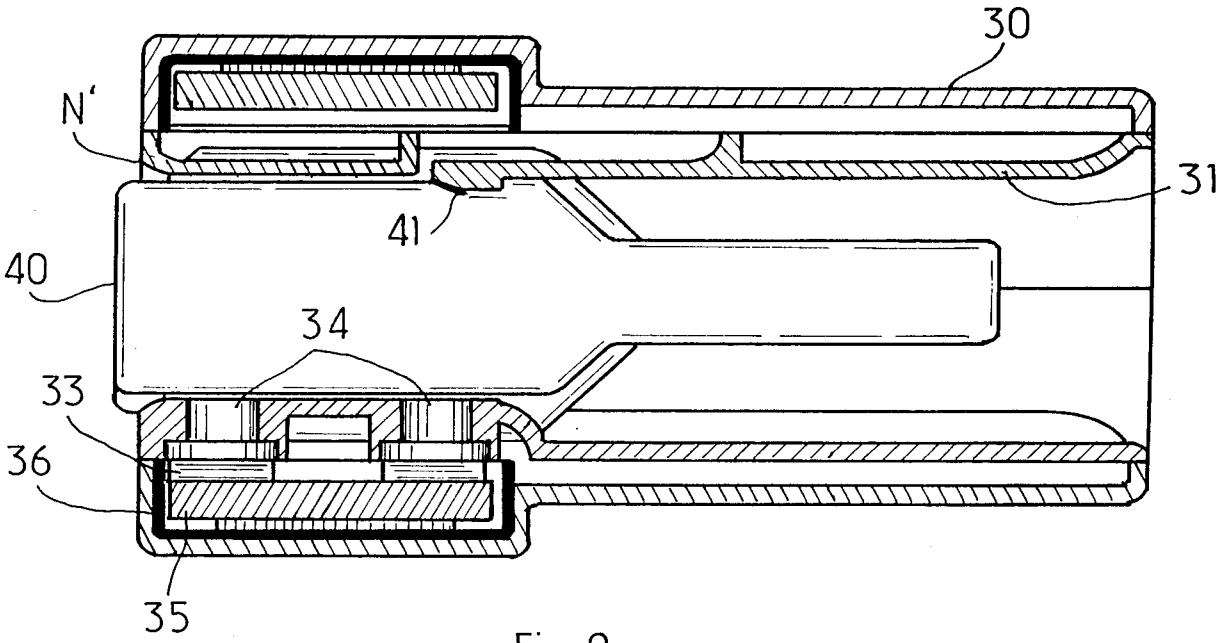
FIG. 9 is a lengthwise cut-away of the same blister opening tunnel.
Figure 10:
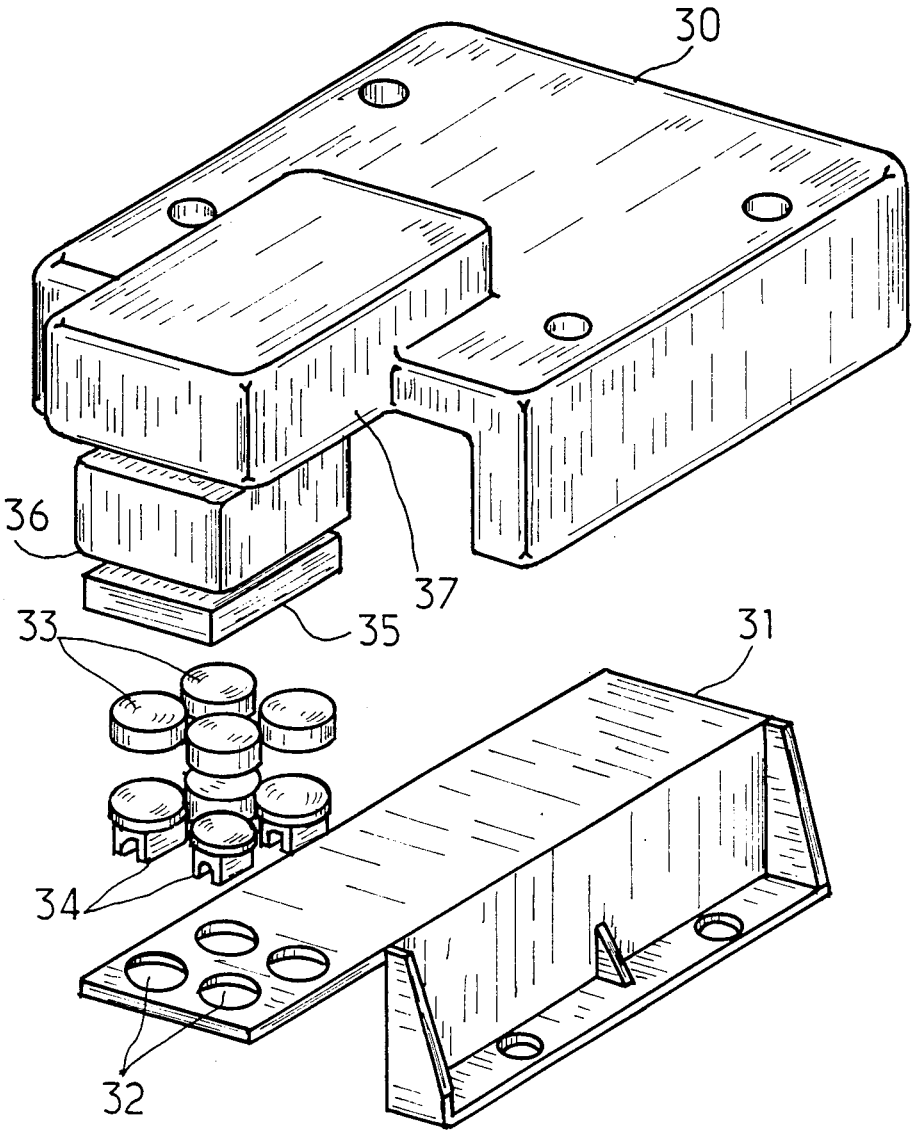
FIG. 10 is a blow-out view of one of the halves of the blister.

If we now refer to FIGS. 8 to 10, we can see that this blister opener consists in a tunnel with a slightly rectangular section whose walls, at the opening, have ribs N' directed inwards, that correspond in number and in layout to the grooves C of the box of the system.

This therefore allows the inserting of the system whose parts are very similar to the active parts of the blister opening system.

The latter consists in, at the top and at the bottom, a semi-hood 30, in which is lodged a semi-guide 31, perforated following 32 so as to receive four samarium-cobalt magnets 33, held by the polar parts 34, all of this being lodged in a cylinder head 35 to take it to an armor-sheeting 36 that is lodged in a chamber 37 of the semi-hood 30.

We see in FIG. 9 the layout of these magnets, placed at the four corners of a square.

This square has the same dimensions as both of the gears E, but since the gears E have turned after the placing of the system onto the blister flaps, when the locking system is inserted into the opening of the tunnel, designated by 40 in FIG. 9, the gap between the positions of the magnets of the mobile gears and of the magnets of the blister opening tunnel is such that the gears start rotating under the effect of the attraction of the magnets between themselves.

This rotating movement results in putting the bump 21 and the notch 20 together in each gear, and the two gears are free to move axially along their shaft 13. Because of the mutual attraction of the magnets of the blister opening tunnel and of the gears, these two gears are pulled apart, and this frees the system and then allows to extract the flaps from the locking system.

The locking system stays in the tunnel from which it will be ejected towards the back when the next system to be unlocked is inserted.

A pawl 41 provided at the back of the active part of the blister opening tunnel prevents the locking system from being taken out of the tunnel when the freed blister is taken out.

As shown in the preceding description, thanks to the system according to the invention, we have the benefit of a double security, the first being assured by the system of axial moving of the gears, in a way that can be compared to the variant shown in FIG. 1, but with mechanical elements replacing the magnetical elements to hold the gears in place, and second, a security during rotation, obtained by the same mechanical means, and which prevents any accidental or malevolent opening of the blister, but with enough means to be stronger than the mechanical moving together of the two gears under the effect of the springs.

The only way to beat this double action is either to use the blister opener when the system is placed on the flaps, either the particular configuration of the flaps, such as illustrated notably in FIGS. 11*a*, 11*b*, 11*c* which precisely show the three stages of putting the system into place:

in FIG. 11*a*, the two gears are either symetrical with respect to the flaps and to their shafts, then in FIG. 11*b* two pairs of cam-slopes cause the rotation of the gears which allows to put the system into place, and then, in FIG. 11*c*, the system unlocks itself under the compression and the rotation of the springs.

Of course, other variations can be conceived, which of course will take after the same principle as seen in the claims hereafter.

Therefore, to prevent the understanding of the functioning of the system, which will increase even more the security, it will preferably be made "invisible" in an opaque box.

It must be understood that the use of this kind of impregnable locking is not limited to this application on blisters, but may be extended to all of the cases when a closed mobile box is to be made impregnable, e.g. the "lead sealing" systems of safes, cases, attache-cases, containers and analog.

I claim:

1. Impregnable locking system of the fastening of displayboxes called "blisters", consisting in a box in two articulated halves having on the side opposite their hinge fastening flaps destined to be held one against the other by this system, characterized in that it consists in a clip destined to cover these two flaps, and between which is attached a transversal shaft; a vertical notch made in the flaps allowing this shaft to go through when the clip is put into place, two gears being slid onto this shaft, between the outer side of each flap and the corresponding side of the clip, the means being provided so that these gears are constantly pushed towards each other, and once this clip placed on the flaps, the gears come to rest in the lodgings made in the outer sides of the flaps therefore immobilizing the clip onto the flaps, external means being provided to push the gears in the opposite direction to take them out of the lodgings to allow the extraction of the clip and to free the flaps of the blister to allow its opening.

2. System according to claim 1, characterized in that the first means consists in a pair of permanent magnets and the second means consists in an electro-magnet exerting on soft iron parts assembled in the gears an attraction superior to the mutual attraction of the permanent magnets.

3. System according to claim 1, characterized in that the first means consists in a pair of springs pushing the gears towards each other, and the second means consists in a set of magnetic elements exerting their attraction on a set of ferrites assembled in the gears.

4. System according to claim 3, characterized in that the gears are slid between two stops on their common shaft, and the springs that push them axially simultaneously have a circular action by pushing them against one of the stops, the external side of each gear and the corresponding internal side of the clip having a ridge/-lodging couple that prevents the accidental pushing apart of the gears towards each other if the circular action of the springs is not compensated by the use of external magnetic elements.

5. System according to claim 4, characterized in that, in order to mechanically compensate the circular action of the springs when the system is put into place on the blister, the top parts of the internal sides of the notches in the blister flaps have inclined gradients that co-operate with the corresponding gradients of the gears, determining their rotation while allowing the necessary distance when the system is adapted to the blister.

6. System according to claim 4, characterized in that it is associated to an opening device having magnetic elements corresponding to those of the gears in such a way that these magnetic elements cause, when the system is inserted into this device, the rotation and the separating of the two gears.

7. System according to claim 6, characterized in that in order to reduce the space between the magnetic elements of the locking system and its opening device, the respective external and internal sides of the system and of the device have alternating ribs and grooves, co-operating with each other so as to guide one into the other, and the reducing of the thickness of the two boxes co-operating with each other.

* * * * *